US005824627A

United States Patent [19]

McConnachie et al.

[11] Patent Number: 5,824,627

[45] Date of Patent: Oct. 20, 1998

[54] HETEROMETALLIC LUBE OIL ADDITIVES

[75] Inventors: Jonathan M. McConnachie, Flemington; Catherine Louise Coyle, Mendham, both of N.J.; Mark Alan Greaney, Upper Black Eddy, Pa.; Edward Ira Stiefel, Bridgewater, N.J.

[73] Assignee: Exxon Research and Engineering Company, Florham Park, N.J.

[21] Appl. No.: 766,829

[22] Filed: Dec. 13, 1996

[51] Int. Cl.[6] ..... C10M 139/00

[52] U.S. Cl. ..... 508/363; 508/365; 508/367; 508/370; 508/379

[58] Field of Search ..... 508/335, 367, 508/363, 365, 420, 370, 379; 556/31, 39

[56] References Cited

U.S. PATENT DOCUMENTS

| | | | |
|---|---|---|---|
| 2,951,040 | 8/1960 | Hugel et al. . | |
| 3,086,984 | 4/1963 | Dubeck | 508/363 |
| 3,419,589 | 12/1968 | Larson et al. | 260/429 |
| 3,840,463 | 10/1974 | Froeschmann et al. | 252/42.7 |
| 4,369,119 | 1/1983 | de Vries et al. | 508/335 |
| 4,395,343 | 7/1983 | de Vries et al. | 508/335 |
| 4,559,152 | 12/1985 | Schlicht | 252/32.7 |
| 4,705,641 | 11/1987 | Goldblatt et al. | 252/35 |
| 4,730,064 | 3/1988 | Halbert et al. | 556/15 |
| 4,786,423 | 11/1988 | Schroeder | 508/363 |
| 4,846,983 | 7/1989 | Ward, Jr. | 508/363 |
| 4,849,123 | 7/1989 | Tipton et al | 508/363 |
| 4,915,857 | 4/1990 | Emert et al. | 252/32.7 |
| 4,966,719 | 10/1990 | Coyle et al. . | |
| 4,978,464 | 12/1990 | Coyle et al. | 252/42.7 |
| 4,995,996 | 2/1991 | Coyle et al. . | |
| 5,013,467 | 5/1991 | Emert et al. | 252/46.4 |
| 5,049,290 | 9/1991 | Emert et al. | 252/32.7 |

FOREIGN PATENT DOCUMENTS

| | | | |
|---|---|---|---|
| 95/07963 | 3/1995 | WIPO | C10M 141/08 |
| 95/19411 | 7/1995 | WIPO | C10M 135/18 |

OTHER PUBLICATIONS

Jain, et al. "The role of metallic stearate additions in solid lubricants", Wear, 148 (1991), 1–13, date unknown.

Shibahara, "Synthesis of sulphur–bridged molybdenum and tungsten coordination compounds", Coordination Chemistry Reviews, 123 (1993), 73–147, month unknown.

*Primary Examiner*—Margaret Medley
*Attorney, Agent, or Firm*—Linda M. Scuorzo

[57] ABSTRACT

The invention relates to lube oil compositions containing a major amount of a lube oil and a minor amount of at least one compound containing a heterometallic tetranuclear preferably cubane, more preferably thiocubane core having 1 to 3 molybdenum atoms and the remainder Co, Cr, Cu, Ni, W, Mn, and Fe. Preferred is Cu. Thiocubane cores are also preferred and these typically have the formula $M_{4-y}Mo_yS_4L_nQ_z$, wherein y is 1 to 3, n is 2 to 6 and z is 0 to 4. Additive concentrates of the compounds as well as the method of making the compositions are disclosed.

20 Claims, No Drawings

HETEROMETALLIC LUBE OIL ADDITIVES

FIELD OF THE INVENTION

The present invention relates to lubricant compositions and methods of making them.

BACKGROUND OF THE INVENTION

Molybdenum disulfide is a known lubricant additive. Unfortunately, it has certain known disadvantages some of which are caused by its insolubility in lubricating oils. Therefore, certain oil-soluble molybdenum sulfur-containing compounds have been proposed and investigated as lubricant additives. For example, U.S. Pat. No. 2,951,040 discloses an oil-soluble molybdic xanthate as useful in lubricating compositions. U.S. Pat. No. 3,419,589 discloses the use of certain "sulfurized" molybdenum (VI) dithiocarbamates as lubricant additives. These additives are described as being oil-soluble or at least capable of being easily suspended in oils. U.S. Pat. No. 3,840,463 discloses the use of certain metal dithiocarbamates or dithiophosphates in combination with metal-free additives that contain sulfur and phosphorus. U.S. Pat. No. 4,966,719, U.S. Pat. No. 4,995,996, and U.S. Pat. No. 4,978,464 all relate to the preparation and use of molybdenum compounds.

U.S. Pat. No. 4,705,641 discloses the mixture of certain copper salts and molybdenum salts in a basestock as antioxidants and antiwear agents and Shibahara, Coord. Chem. Rev. 123, 73–148 (1993) discloses certain molybdenum and heteronuclear compounds. U.S. Pat. No. 4,730,064 discloses mixed copper-molybdenum complexes. However, the uses or benefits of copper molybdenum sulfur complexes in lubrication have not been disclosed.

There is a continuing need for additives that demonstrate enhanced lubricating properties, particularly friction reduction and/or anti-wear, and antioxidancy and that are compatible with existing additive packages. Applicants' invention addresses these needs.

SUMMARY OF THE INVENTION

The present invention provides for a lubricating oil composition, comprising: a major amount of an oil of lubricating viscosity in combination with an effective minor amount of an oil soluble or dispersible compound containing a heterometallic tetranuclear core having 1 to 3, preferably 2 to 3, molybdenum atoms and the remaining atoms selected from the group consisting of Mn, Co, Cr, Cu, Ni, W and Fe.

Additionally, oxygen and selenium can substitute for sulfur in the core of many of these compounds.

The tetranuclear compounds are useful in formulating lubricating oil compositions having enhanced lubricating (i.e., friction reducing and anti-wear) properties.

The present invention also provides for the method of making the lube oil compositions and concentrates disclosed herein by combining a major amount of an oil of lubricating viscosity, and a minor amount of a compound containing a heterometallic tetranuclear, preferably cubane, more preferably thiocubane core having 1 to 3, preferably 2 to 3, molybdenum atoms and the remaining atoms selected from the group consisting of Mn, Co, Cr, Cu, Ni, W and Fe.

The present invention also provides for a method of lubricating mechanical engine components particularly an internal combustion engine by adding an oil of lubricating viscosity containing at least one compound containing a heterometallic tetranuclear, preferably cubane, more preferably thiocubane, core having 1 to 3, preferably 2 to 3, molybdenum atoms and the remaining atoms selected from Mn, Co, Cr, Cn, Ni, W and Fe.

Also included are additive concentrates for blending with lubricating oils, comprising an oleagenous carrier and from about 1 to about 90 weight percent based on the weight of the concentrate of the previously described tetranuclear compounds.

Preferred compounds have a thiocubane core, and more preferably are of the formula $M_{4-y}Mo_yS_4L_nQ_z$, and mixtures thereof, wherein M is a metal selected from Mn, Co, Cr, Cu, Ni, W and Fe, the L, ligands, are independently selected ligands, Q is selected from the group of neutral electron donating compounds, wherein y is 1 to 3 preferrably 2 to 3, and wherein n ranges from 2 to 6 and z ranges from 0 to 4, wherein the total charge provided by the ligands, L, is sufficient to neutralize the positive charge on the $M_{4-y}MO_yS_4$ core. Preferred thiocubane cores contain Cu and Mo and or copper and molybdenum the more preferred cores have the formula $Cu_2Mo_2S_4$ and $CuMo_3S_4$. The compounds should be oil soluble or dispersible.

The present invention may suitably comprise, consist or consist essentially of the elements described herein and includes the products produced by the processes disclosed herein.

Thus the lubricant compositions of this invention demonstrate enhanced antioxidancy and lubricating properties, particularly antiwear and friction-reducing properties, and are compatible with other additives used in formulating commercial lubricating compositions.

DETAILED DESCRIPTION OF THE INVENTION

The lubricant compositions of the present invention include a major amount of oil of lubricating viscosity. This oil may be selected from vegetable, animal, mineral or synthetic oils. The oils may range in viscosity from light distillate mineral oils to heavy lubricating oils such as gas engine oil, mineral lubricating oil, motor vehicle oil, and heavy duty diesel oil. The oils may be unrefined, refined and re-refined. In general, the viscosity of the oil will range from about 2 centistokes to about 30 centistokes and especially in the range of 5 centistokes to 20 centistokes at 100° C.

The lubricant compositions of the present invention include a minor amount of a compound containing at least one heterometallic tetranuclear core. The minor amount of the compound should be an effective amount to produce the enhanced antioxidancy and lubricating performance, particularly friction reducing and/or antiwear properties in the oil. The lubricant compositions may include a mixture of the compounds containing the heterometallic tetranuclear cores of the types disclosed herein, the lubricating oil and/or any other additives per se, and/or of any intermediates and reaction products occurring as a result of the mixture.

Preferably the heterometallic tetranuclear core have a cubane, more preferably a thiocubane, core. The thiocubane containing compounds are selected from compounds represented by the formula $M_{4-y}Mo_yS_4L_nO_z$ and mixtures thereof. In the formula, M is a metal selected from Mn, Co, Cr, Cu, Ni, W and Fe, preferably Cu; L are independently selected, preferably monoanionic, ligands having organo, preferably hydrocarbyl, groups with a sufficient number of carbon atoms to render the compound soluble or dispersible in the oil; Q is selected from the group of neutral electron donating compounds, including water, amines, alcohols, phosphines, and ethers; y is 1 to 3 preferably 2 to 3; n ranges from 2 to 6; and z ranges from 0 to 4. For example, when the compound is a dicopper-dimolybdenum sulfur complex M is Cu, y is 2, n is 4 and z is 2 and when the compound is a monocopper trimolybdenum sulfur compound M is Cu, y is 3, n is 5 and z ranges from 0 to 1.

The ligands, L, are independently selected from the group of:

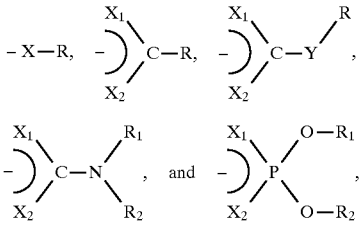

and mixtures thereof, wherein X, $X_1$, $X_2$, and Y are independently selected from the group of oxygen and sulfur, and wherein $R_1$, $R_2$, and R are independently selected from the group consisting of hydrogen and organo, groups that may be the same or different. Preferably the organo groups are hydrocarbyl groups such as alkyl, (e.g., in which the carbon atom attached to the remainder of the ligand is primary, secondary, tertiary) aryl, substituted aryl and ether groups. More preferably, each ligand has the same hydrocarbyl group. Importantly, the organo groups of the ligands have a sufficient number of carbon atoms to render the compound soluble or dispersible in the oil. The compound's oil solubility or dispersibility may be influenced by the number of carbon atoms in the ligands. In the compounds in the present invention, the total number of carbon atoms present among all of the organo groups of the compounds' ligands typically will be at least 21, such as at least 25, at least 30, or at least 35. Preferably the ligand source chosen has a sufficient number of carbon atoms to render the compound soluble or dispersible in the oil. For example, the number of carbon atoms in each alkyl group will generally range between about 1 to 100, preferably 1 to 30 and more preferably between 4 to 20. Preferred ligands include dialkyldithiophosphate ("ddp"), xanthates, thioxanthates, and dialkyldithiocarbamate ("dtc"), and of these dialkyldithiocarbamate is more preferred.

Organic ligands containing at least two of the above functionalities are also capable of binding to at least one of the cores and serving as ligands. The ligands may be multidentate. Without wishing to be bound by any theory, it is believed that one or more cores may be bound or interconnected by means of at least one multidentate ligand. This includes the case of a multidentate ligand having multiple connections to one core. Such structures fall within the scope of this invention. Those skilled in the art will recognize that formation of the compounds requires selection of ligands having the appropriate charges to balance the core's charge.

The term "hydrocarbyl" denotes a substituent having carbon atoms directly attached to the remainder of the ligand and is predominantly hydrocarbyl in character within the context of this invention. Such substituents include the following: (1) hydrocarbon substituents, that is, aliphatic (for example alkyl or alkenyl), alicyclic (for example cycloalkyl or cycloalkenyl) substituents, aromatic-, aliphatic and alicyclic-substituted aromatic nuclei and the like, as well as cyclic substituents wherein the ring is completed through another portion of the ligand (that is, any two indicated substituents may together form an alicyclic group); (2) substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.); (3) hetero substituents, that is, substituents which, while predominantly hydrocarbon in character within the context of this invention, contain atoms other than carbon present in a chain or ring otherwise composed of carbon atoms.

Compounds having the formula $M_{4-y}Mo_yS_4L_nQ_z$ useful as additives in the present invention are believed to have at least one cubane, preferably thiocubane core of the formula $M_{4-y}Mo_yS_4$ surrounded by ligand, wherein M, y and k, $L_n$ and $Q_z$ are as described previously. The cubane cores are illustrated by the structures:

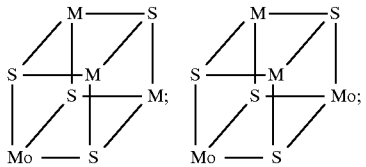

and

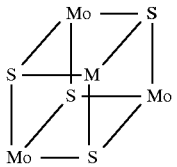

wherein M is selected from the metals described previously.

When M is Cu the preferred cores are illustrated by the following structures:

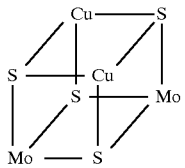

for the $Cu_2Mo_2S_4$ core; and

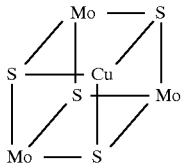

for the $CuMo_3S_4$ core.

The compounds useful as additives in the present invention can be prepared generally as follows:

Oil-soluble or dispersable tetranuclear thiocubane compounds can be prepared by reacting a molybdenum source with a source of a non-molybdenum metal ("M" wherein M is Mn, Co, Cr, Cu, Ni, W and Fe) component(s) in suitable liquid(s)/solvent(s); if desired, additional ligands can be included in the reaction or added once an initial complex is formed. For example, tetranuclear thiocubane compounds with three molybdenum atoms may be synthesized in the appropriate ligand(s)/solvent(s) by reacting a trinuclear molybdenum source such as $Mo_3S_4(dtc)_4$ with a non-molybdenum metal ("M" wherein M is as described above)

source such as CuCl followed by ligand substitution with a ligand such as a thiolate. Similarly, a tetranuclear thiocubane compounds with two molybdenum atoms may be synthesized in the appropriate liquid(s)/solvent(s) by reacting a dinuclear molybdenum source such as $Mo_2S_4(dtc)_2$ with a non-molybdenum metal ("M" as described above) source such as CuCl followed by ligand substitution with a ligand such as a carboxylate. Tetranuclear thiocubane compounds with one molybdenum atom may be synthesized in the appropriate solvent(s) by reacting a molybdenum source such as $Mo(CO)_6$ with a non-molybdenum metal ("M" as described above) source such as $W_3S_4(dtc)_4$ and a ligand source such as thiuram disulfide. Suitable ligand(s)/solvent (s) may be, e.g., aqueous or organic. More specifically, the process includes a method for making an oil soluble compound having a tetranuclear thiocubane core by combining a liquid/solvent containing a molybdenum source, a sulfur source, non-molybdenum metal ("M" as described above) source and, a ligand source to form an oil soluble compound having a tetranuclear thiocubane core; and a method for making an oil soluble compound having a tetranuclear thiocubane core containing three molybdenum atoms in the core by combining a liquid containing a trinuclear molybdenum source, a non-molybdenum metal ("M" as described above) source and, a ligand source to form an oil soluble compound having a tetranuclear thiocubane core having three molybdenum atoms; and includes a method for preparing an oil soluble compound having a tetranuclear thiocubane core with two molybdenum atoms in the core by combining a liquid containing a dinuclear molybdenum source, a non-molybdenum metal source and a ligand source to form an oil soluble compound having a tetranuclear thiocubane core having two molybdenum atoms.

In general, the compounds can be purified by well known techniques such as chromatography; however, it may not be necessary to purify the compounds.

The lubricating compositions contain minor effective amounts, preferably ranging from 1 ppm to 2000 ppm molybdenum from the compounds containing the heterometallic tetranuclear core (of the types described previously), more preferably 5 to 750 ppm, most preferably 10 to 300 ppm, all based on the weight of the lubricating composition. For example, with the copper molybdenum sulfur-containing compounds, the enhancement in lubricating performance can be seen at concentrations of Cu from the heterometallic tetranuclear core-containing compounds (of the types described previously) of at least 1 ppm to 1000 ppm, preferably 1 to 200 ppm. Within the above ranges one skilled in the art can select the particular combination of amounts desired to produce the enhancement in antioxidancy and lubricating properties (friction reduction and/or anti-wear), desired for the particular application. The selection within these ranges may be accomplished to optimize for enhanced antioxidancy, friction reducing or anti-wear performance or all three.

These benefits can be achieved in basestock as well as fully formulated lube oils. Essentially or substantially phosphorous free and/or sulfur free oils also may be treated. A lubricating composition that is essentially or substantially free of phosphorus and/or sulfur is one in which the amount of phosphorus and/or sulfur is not more than is inherently present in base oils of lubricating viscosity.

The lubricating oil compositions of the present invention may be prepared by combining a major amount of an oil of lubricating viscosity and an effective minor amount of compounds containing the heterometallic tetranuclear cores which are described more specifically above. This preparation may be accomplished by admixing the complex directly with the oil or by first combining the complex in a suitable carrier fluid to achieve oil solubility or dispersibility, then adding the mixture to the lubricating oil.

Concentrates of the compounds in a suitable oleagenous, preferably hydrocarbon, carrier provide a convenient means of handling the compounds before their use. Oils of lubricating viscosity, such as those described above as well as aliphatic, naphthenic, and aromatic hydrocarbons are examples of suitable carrier fluids for the concentrates. These concentrates may contain about 1 to about 90 weight percent of the compound based on the weight of concentrate, preferred is 1 to 70 weight percent, more preferably, 20 to 70 weight percent.

The lubricating oil compositions made by combining an oil of lubricating viscosity herein and at least one compound containing a heterometallic tetranuclear, preferably cubane, core of the types and in the amounts described herein may be used to lubricate mechanical engine components, particularly an internal combustion engine by adding the lubricating oil composition thereto.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Advantageously, the use of compound containing the heterometallic tetranuclear cores as described in the present invention, may decrease the need for the use of separate metal, e.g., copper and molybdenum additives, thus providing an opportunity to decrease attendant blending and related costs.

Known lubricant additives may also be used for blending in the lubricant compositions of this invention. These include, for example, those containing phosphorous, dispersants, detergents, e.g., single or mixed metal, pour point depressants, viscosity improvers, antioxidants, surfactants, other friction modifiers, antiwear agents and the like. These can be combined in proportions known in the art.

The invention will be more fully understood by reference to the following examples illustrating various modifications of the invention which should not be construed as limiting the scope thereof

GENERAL

As used herein "coco" is an alkyl chain or mixtures of chains of varying even numbers of carbon atoms typically of from about typically $C_8$ to $C_{18}$.

The procedures and equipment used for the Falex Block-On-Ring tests herein were similar to those used in ASTM G77-83 (Ranking Resistance of Materials to Sliding Wear Using Block-On-Ring Wear Test).

EXAMPLES

Example 1: Synthesis of $Cu_2Mo_2S_4(coco_2dtc)_2$ (dodecylthiolate)$_2$

Copper (I) chloride (0.2 g, 2 mmol) and $Mo_2S_4(coco_2dtc)_2$ (1.2 g, 1 mmol) were mixed together in a 1:1 solution of dichloromethane and methanol (total volume, 50 mL) and allowed to stir at room temperature for eight hours. A methanol solution (25 mL) of potassium dodecylthiolate (0.51 g, 2 mmol) was then added to the copper-molybdenum containing solution. Additional dichloromethane (50 mL) was added to the flask and the solution was allowed to stir for 24 hours. The dichloromethane was pumped off and the methanol decanted. The tarry material at the bottom of the flask was dissolved in pentane, filtered, and dried under vacuum to yield $Cu_2Mo_2S_4(coco_2dtc)_2$(dodecylthiolate)$_2$.

Example 2: Synthesis of $Cu_2Mo_2S_4(coco_2dtc)_2$(oleate)$_2$

Copper (I) chloride (0.2 g, 2 mmol) and $Mo_2S_4(coco_2dtc)_2$ (1.2 g, 1 mmol) were mixed together in a 1:1 solution of dichloromethane and methanol (total volume, 50 mL) and allowed to stir at room temperature for eight hours. A methanol solution (25 mL) of potassium oleate (0.67 g, 2 mmol) was then added to the copper-molybdenum containing solution. Additional dichloromethane (50 mL) was added to the flask and the solution was allowed to stir for 24 hours. The dichloromethane was pumped off and the methanol decanted. The tarry material at the bottom of the flask was dissolved in pentane, filtered, and dried under vacuum to yield $Cu_2Mo_2S_4(coco_2dtc)_2$(oleate)$_2$.

Example 3: Synthesis of $CuMo_3S_4(octyl_2dtc)_4$(thiolate)

Copper (I) chloride (0.1 g, 1 mmol) and $Mo_3S_4(octyl_2dtc)_4$ (1.68 g, 1 mmol) were added to tetrahydrofuran ("THF") (50 mL), allowed to stir at room temperature for 24 hours, and the reaction was filtered. A methanol solution (10 mL) of potassium dodecylthiolate (0.25 g, 1 mmol) was then added to the copper-molybdenum filtrate. The combined solution was stirred for eight hours, after which the THF was pumped off, the tar redissolved in pentane, the solution filtered, and the pentane pumped off to yield $CuMo_3S_4(octyl_2dtc)_4$(thiolate).

Example 4: Synthesis $CuMo_3S_4(octyl_2ddp)_4$(thiolate)

Copper (I) chloride (0.1 g, 1 mmol) and $Mo_3S_4(octyl_2ddp)_4$ (1.83 g, 1 mmol) were added to THF (50 mL), allowed to stir at room temperature for 24 hours, and the reaction was filtered. A methanol solution (10 mL) of potassium dodecylthiolate (0.25 g, 1 mmol) was then added to the copper-molybdenum filtrate. The combined solution was stirred for eight hours, after which the THF was pumped off, the tar redissolved in pentane, the solution filtered, and the pentane pumped off to yield $CuMo_3S_4(octyl_2ddp)_4$ (thiolate).

In Examples 5 through 8 the compounds in the invention were evaluated for friction and wear performance in a Falex Block-On-Ring test procedure. The data were acquired at a speed of 420 rpm (44 radians/sec), 220 lb. (100 kg), and a temperature of 100° C. for 2 h. In Examples 5–9 the samples tested consisted of Solvent 150 Neutral (S150 N) lubricating oil, 1% zinc dialkyldithiophosphate ("ZDDP"), and the additive compounds containing 500 ppm molybdenum based on the total weight of the lubricating oil. Friction coefficients are reported as both the end of run value and the average value over the entire 2 hours. Data reported included the block wear scar volume, measured by profilometry, the end of test friction coefficient ("Last Coef."), and the average friction coefficient ("Avg. Coef.") obtained over the 2 hour test. The end of test friction coefficient is that friction coefficient determined at the end of the test period and the average friction coefficient provides information on the activity of the added material, i.e., samples that attain the same low friction coefficients faster are considered to contain more active, friction-reducing compounds.

Example 9 (Comparative)

For comparative purposes, the Falex Block-On-Ring was conducted using only Solvent 150 Neutral (S150N) and 1% ZDDP. The results are shown in Table I.

TABLE I

S150N + 1% ZDDP + Additive (at 500 ppm Mo)

| Test Run | Additive | Wear Vol. ($10^{-2}$ $mm^3$) | Last Coef. | Avg. Coef. |
|---|---|---|---|---|
| Ex. 5 | $Cu_2Mo_2S_4(coco_2dtc)_2$(dodecylthiolate)$_2$ | 0.85 | 0.042 | 0.051 |
| Ex. 6 | $Cu_2Mo_2S_4(coco_2dtc)_2$(oleate)$_2$ | 0.84 | 0.035 | 0.046 |
| Ex. 7 | $CuMo_3S_4(octyl_2dtc)_4$(dodecylthiolate) | 1.65 | 0.044 | 0.055 |
| Ex 8. | $CuMo_3S_4(octyl_2ddp)_4$(dodecylthiolate) | 2.37 | 0.053 | 0.074 |
| Ex. 9 | None | 1.06 | 0.111 | 0.112 |

In Examples 10 through 12 the compounds were evaluated for friction and wear performance in a Falex Block-On-Ring test procedure. The data was obtained at a speed of 420 rpm (44 radians/sec), 220 lb. (100 kg), and a temperature of 100° C. for 2 h. In Examples 5–9 the samples tested consisted of 10W30 fully formulated motor oil, combined with the additive compounds containing 500 ppm molybdenum based on the total weight of the lubricating oil.

Example 13 (Comparative)

For comparative purposes, the Falex Block-On-Ring test was conducted using a 10W30 fully formulated motor oil. The results are shown in Table II.

TABLE II

10w30 + Additives (at 500 ppm Mo)

| Test Run | Additive | Wear Vol. ($10^{-2}$ $mm^3$) | Last Coef. | Avg. Coef. |
|---|---|---|---|---|
| Ex. 10 | $Cu_2Mo_2S_4(coco_2dtc)_2$(dodecylthiolate)$_2$ | 0.91 | 0.034 | 0.042 |
| Ex. 11 | $Cu_2Mo_2S_4(coco_2dtc)_2$(oleate)$_2$ | 0.76 | 0.035 | 0.041 |
| Ex. 12 | $CuMo_3S_4(octyl_2dtc)_4$(dodecylthiolate) | 0.76 | 0.029 | 0.038 |
| Ex. 13 | None | 2.86 | 0.132 | 0.130 |

What is claimed is:

1. A lubricating oil composition, comprising: a major amount of an oil of lubricating viscosity to which is added a minor amount of an additive having the formula $M_{4-y}Mo_yS_4L_nQ_z$ and mixtures thereof, wherein M is a metal selected from Cr, Mn, Fe, Co, Ni, Cu, and W, L is independently selected organic groups selected from dithiophosphates, thioxanthates, phosphates, dithiocarbamates, thiophosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}Mo_yS_4$ core.

2. The compositions of claim 1 wherein M is Cu and when y is 3, n is 5 and z ranges from 0 to 1.

3. The composition of claim 1 wherein y is 2 to 3.

4. The composition of claim 1 wherein M is Cu and when y is 2, n is 4 and z is2.

5. The composition of claim 1 wherein M is selected from the group consisting of Cu, Co and Mn.

6. The composition of claim 1 wherein M is Cu.

7. The composition of claim 1 wherein the neutral electron donating compounds are selected from the group consisting of water, amines, alcohols, phosphines and ethers.

8. The composition of claim 1 wherein the ligands, L, are represented by at least one structure having the formula:

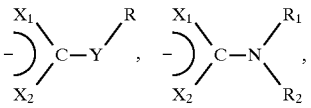

and

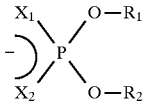

wherein X, $X_1$, $X_2$, and Y are oxygen or sulfur and wherein $R_1$, $R_2$, and R are independently selected from the group consisting of hydrogen and organo groups.

9. The composition of claim 8 wherein the organo groups are independently selected from alkyl, aryl, substituted aryl, and ether groups.

10. The composition of claim 9 wherein the organo groups are alkyl groups and the number of carbon atoms in each alkyl group ranges from about 1 to 100.

11. The composition of claim 10 wherein the number of carbon atoms in each alkyl group range from about 1 to about 30.

12. The composition of claim 8 wherein the total number of carbon atoms in all ligands' organo groups is at least 21.

13. The composition of claim 8 wherein the ligands, L, are independently selected from dialkyldithiophosphate, thioxanthates, dialkylphosphate, dialkyldithiocarbamate, dialkylthiophosphate, and xanthates.

14. The composition of claim 1 wherein the Mo from the compounds is present in an amount of at least about 1 to 2000 ppm Mo, based on the weight of the lube oil composition.

15. The composition of claim 1 wherein the weight of the Mo from the tetranuclear molybdenum compound is present ranges from about 5 to 750 ppm Mo based on the weight of the lubricating composition.

16. The composition of claim 1 wherein the thiocubane core is represented by the formulas:

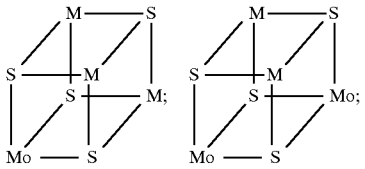

and

-continued

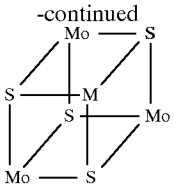

wherein M is selected from the said metals.

17. The composition of claim 1 further comprising at least one of dispersants, detergents, pour point depressants, viscosity modifiers surfactants, antiwear agents and antioxidants.

18. A concentrate for blending with lubricating oils, comprising: an oleagenous carrier and from about 1 to about 90 weight percent based on the weight of the concentrate of an additive having the formula $M_yMo_yS_4L_nQ_z$ and mixtures thereof, wherein M is a metal selected from Cr, Mn, Fe, Co, Ni, Cu and W, L is independently selected organic groups selected from dithiophosphates, thioxanthates, phosphates, dithiocarbamates, thiophosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}Mo_yS_4$ core.

19. A method for making a lubricating oil composition, comprising: combining a major amount of an oil of lubricating viscosity, and a minor amount of at least one additive having the formula $M_{4-y}Mo_yS_4L_nQ_z$ and mixtures thereof, wherein M is a metal selected from Cr, Mn, Fe, Co, Ni, Cu and W, L is independently selected organic groups selected from dithiophosphates, thioxanthates, phosphates, dithiocarbamates, thiophosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}Mo_yS_4$ core.

20. A method for lubricating an internal combustion engine, comprising: adding an oil of lubricating viscosity containing at least one additive having the formula $M_{4-y}Mo_yS_4L_n\ Q_z$ and mixtures thereof, wherein M is a metal selected from Cr, Mn, Fe, Co, Ni, Cu and W, L is independently selected organic groups selected from dithiophosphates, thioxanthates, phosphates, dithiocarbamates, thiophosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}Mo_yS_4$ core to an internal combustion engine.

* * * * *